US009174102B2

(12) United States Patent
Stevenson

(10) Patent No.: US 9,174,102 B2
(45) Date of Patent: Nov. 3, 2015

(54) PUTTER HEAD WITH DISTRIBUTIVE FRAME AND WEIGHTS

(71) Applicant: Robert Stevenson, Pooler, GA (US)

(72) Inventor: Robert Stevenson, Pooler, GA (US)

( * ) Notice: Subject to any disclaimer, the term of this patent is extended or adjusted under 35 U.S.C. 154(b) by 198 days.

(21) Appl. No.: 13/726,322

(22) Filed: Dec. 24, 2012

(65) Prior Publication Data

US 2013/0165256 A1 Jun. 27, 2013

Related U.S. Application Data

(60) Provisional application No. 61/579,189, filed on Dec. 22, 2011.

(51) Int. Cl.

| | |
|---|---|
| ***A63B 69/36*** | (2006.01) |
| ***A63B 53/04*** | (2015.01) |
| ***A63B 53/00*** | (2015.01) |

(52) U.S. Cl.

CPC ..... *A63B 53/0487* (2013.01); *A63B 53/007* (2013.01); *A63B 2053/0433* (2013.01); *A63B 2053/0441* (2013.01); *A63B 2053/0491* (2013.01)

(58) Field of Classification Search

CPC ..... A63B 53/007; A63B 53/0487; A63B 53/065; A63B 69/3676; A63B 69/3685; A63B 2053/0433; A63B 2053/0491; A63B 2053/0441

USPC ..... 473/324–350, 287–292, 219–256; D21/736–746

See application file for complete search history.

(56) References Cited

U.S. PATENT DOCUMENTS

| | | | | | |
|---|---|---|---|---|---|
| 2,781,197 | A | * | 2/1957 | Wiley | 473/249 |
| 4,508,350 | A | * | 4/1985 | Duclos | 473/254 |
| 4,979,744 | A | * | 12/1990 | Alcala | 473/341 |
| 5,090,703 | A | * | 2/1992 | Koumarianos | 473/328 |
| 5,332,223 | A | * | 7/1994 | Johnson | 473/306 |
| 5,423,545 | A | * | 6/1995 | Narry | 473/253 |
| 5,584,770 | A | * | 12/1996 | Jensen | 473/350 |
| 5,695,412 | A | * | 12/1997 | Cook | 473/349 |
| 5,769,736 | A | * | 6/1998 | Sato | 473/335 |
| D407,445 | S | * | 3/1999 | Rollinson et al. | D21/743 |
| D410,267 | S | * | 5/1999 | Solheim et al. | D21/736 |
| 5,961,400 | A | * | 10/1999 | Broom | 473/340 |
| D427,263 | S | * | 6/2000 | Bober | D21/744 |
| 6,080,068 | A | * | 6/2000 | Takeda | 473/305 |
| 6,083,118 | A | * | 7/2000 | Martins et al. | 473/334 |
| D467,291 | S | * | 12/2002 | Ngon | D21/743 |
| 6,497,628 | B1 | * | 12/2002 | Gunderson | 473/313 |
| 6,702,689 | B2 | * | 3/2004 | Ashton | 473/251 |
| 6,988,956 | B2 | * | 1/2006 | Cover et al. | 473/244 |
| 7,648,425 | B2 | * | 1/2010 | Wahl et al. | 473/334 |
| 2007/0155524 | A1 | * | 7/2007 | Cameron | 473/251 |

* cited by examiner

*Primary Examiner* — Sebastiano Passaniti
(74) *Attorney, Agent, or Firm* — Nixon & Vanderhye P.C.

(57) ABSTRACT

A putter head includes a hosel connectable to a club shaft, a frame cooperable with the hosel, and a putter face connected to the frame. The putter face includes a toe portion and a corresponding toe shoulder and a heel portion and a corresponding heel shoulder. The toe shoulder and the heel shoulder define an encasement. Weights are positioned in the encasement respectively adjacent the toe shoulder and the heel shoulder.

15 Claims, 5 Drawing Sheets

PUTTER HEAD WITH DISTRIBUTIVE FRAME AND WEIGHTS

CROSS-REFERENCES TO RELATED APPLICATIONS

This application claims the benefit of U.S. Provisional Patent Application Ser. No. 61/579,189, filed Dec. 22, 2011, the entire content of which is herein incorporated by reference.

STATEMENT REGARDING FEDERALLY SPONSORED RESEARCH OR DEVELOPMENT

Not applicable

BACKGROUND OF THE INVENTION

The invention relates to a putter head with structural features that serve to improve putter head feel.

The "feel" of a golf club, particularly with respect to putters, is important in selecting clubs for purchase/play. Many component parts of the club and features associated with the club combine to define a club's "feel." Exemplary characteristics include club weight, weight distribution, club head material, vibration absorption, and the like, all of which may affect the feel of the club as it strikes a ball. Other features that are important to golfers include the visual appearance of the club and sometimes even the sound produced when the club strikes a ball.

BRIEF SUMMARY OF THE INVENTION

The design according to preferred embodiments evenly distributes mass to outermost portions of the putter face. This distribution provides for solid contact and consistent feel regardless of where on the putter face hitting surface the ball is struck. A weighted bottom portion behind the putter face also serves to improve putter feel while adding stability during a putting stroke.

In an exemplary embodiment, a putter head includes a hosel connectable to a club shaft, a frame cooperable with the hosel, and a putter face connected to the frame. The putter face includes a toe portion and a corresponding toe shoulder and a heel portion and a corresponding heel shoulder. The toe shoulder and the heel shoulder define an encasement. Weights are positioned in the encasement respectively adjacent the toe shoulder and the heel shoulder. The hosel and the frame may be formed of the same material. In one arrangement, the frame is integral with the hosel.

The frame may include a frame border surrounding an open section. In this context, the putter face may be connected to the frame border and may cover the open section on a hitting side of the frame.

The putter face may be shaped such that the frame is positioned entirely within the encasement. The putter face may be secured to the frame via at least one of screws and an adhesive. In one arrangement, the putter face comprises a generally L-shaped construction defined by a hitting surface and the toe and heel shoulders. A height of the toe portion may be greater than a height of the heel portion. Preferably, the weights are positioned adjacent a bottom portion of the frame. The weights may be shaped and positioned to assist with alignment of the putter head. For example, the shape of the weights may define an alignment channel that is perpendicular to a hitting surface of the putter face.

In another exemplary embodiment, a putter head includes a hosel and an integrated frame coupleable with a club shaft, where the frame includes a closed border portion surrounding an open area. An L-shaped putter face is attached to the frame. The putter face includes a hitting surface and shoulder portions that together define the L-shape and an encasement, where the frame is disposed in the encasement. A weighted member is positioned in the encasement.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
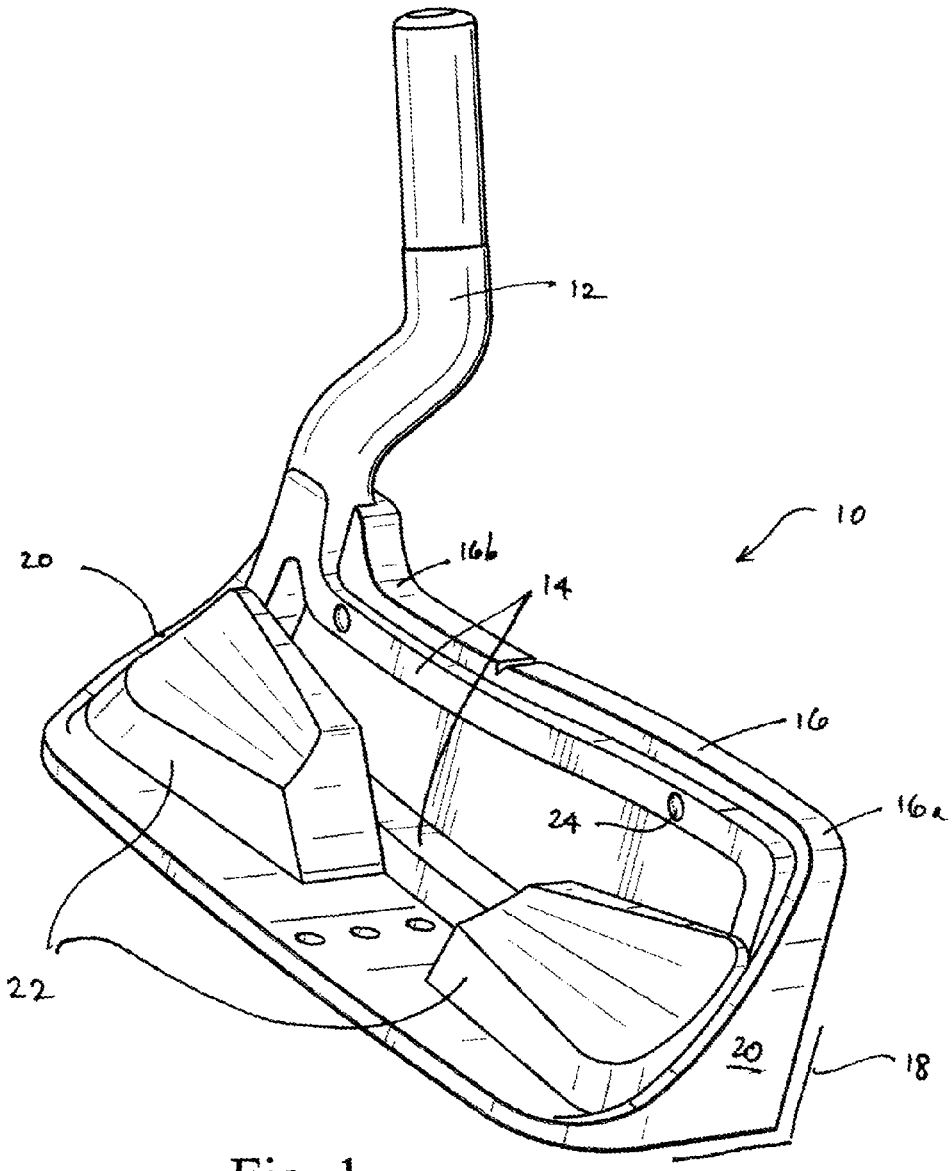
FIG. 1 is a rear perspective view of the putter head according to preferred embodiments.
Figure 2:
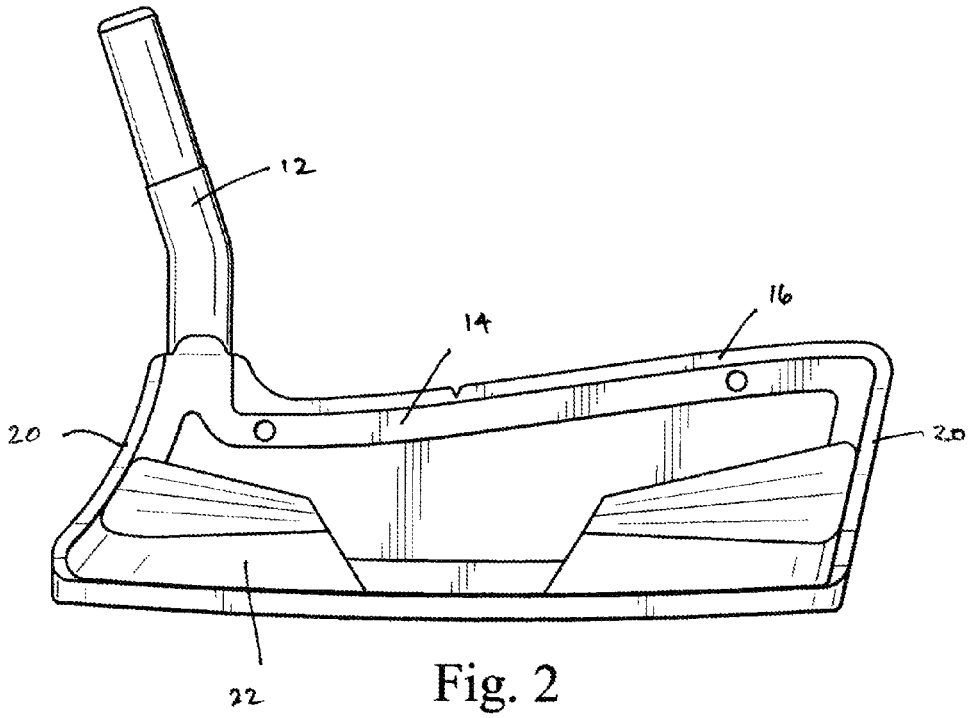
FIG. 2 is a rear view of the putter head.
Figure 3:
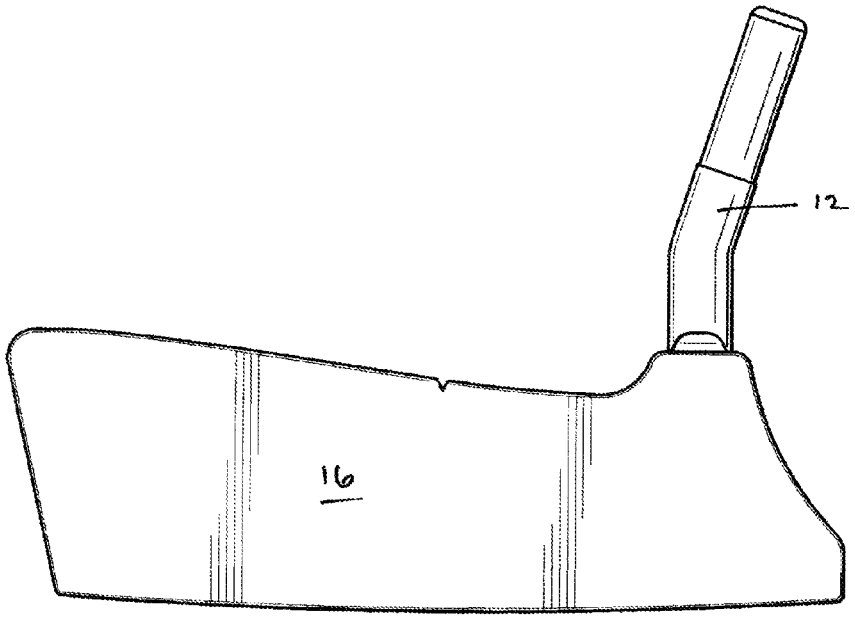
FIG. 3 is a front view of the putter head.

FIGS. 1-8 show various views of the putter head according to the invention. The putter head 10 includes a hosel 12 to which a club shaft (not shown) is connectable. A frame 14 is generally continuous (i.e., integral or bent from the same section of material, etc.) with the hosel 12 and provides a base structure to which the putter face 16 is attached. The frame 14 may alternatively be suitably connected to the hosel. The width of the frame 14 and its continuation from the hosel 12 allows for an equal and stable force to be applied to the putter face 16, which will deliver a uniform feel as well as stable, consistent acceleration to the golf ball. As shown, the frame 14 includes a frame border surrounding an open section. The putter face is connected to the frame border and covers the open section on a hitting side of the frame. The construction of the frame 14 also creates a large sweet spot on the putter face 16, similarly creating a uniform feel and acceleration to the golf ball, regardless of what portion of the face 16 impacts the golf ball.

The putter face 16 includes a generally L-shaped construction 18 and includes shoulder portions 20 that define an encasement or the like for interior components of the putter head 10. The L-shape is defined by the shoulder portions 20 and a hitting surface of the putter face 16. The putter face 16 is preferably shaped such that the frame 14 is positioned entirely within the encasement. As shown, a toe portion **16*a* of the putter face 16 may be taller/higher than a heel portion 16*b*, resulting in a familiar look of an iron at address. Each of the toe portion 16*a* and the heel portion 16*b* includes a corresponding adjacent shoulder portion 20**.

Figure 4:
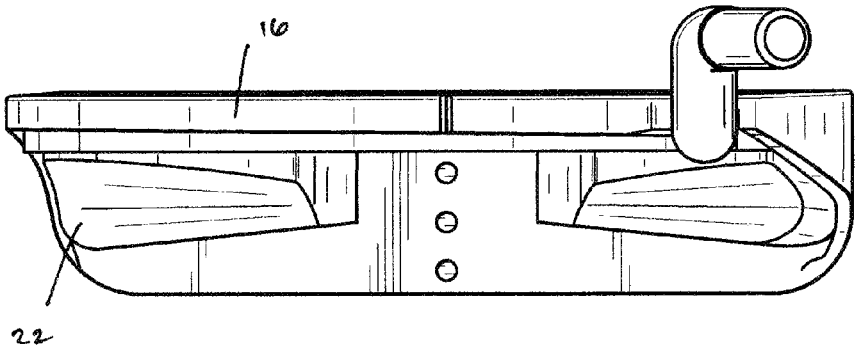
FIG. 4 is a plan view of the putter head.
Figure 5:
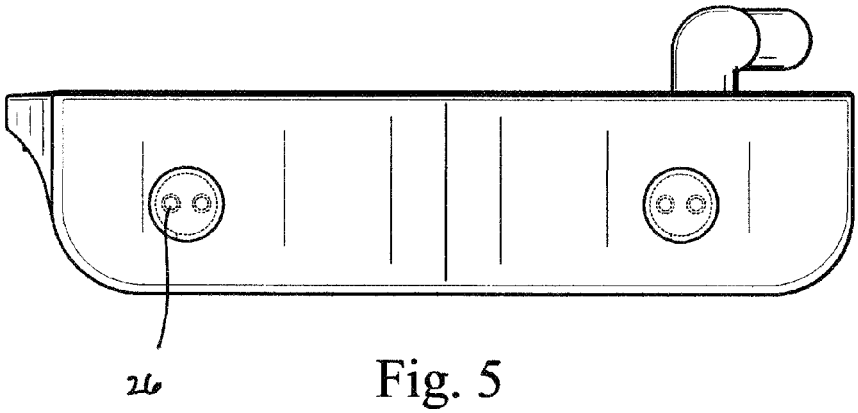
FIG. 5 is a bottom view of the putter head.
Figures 6, 7:
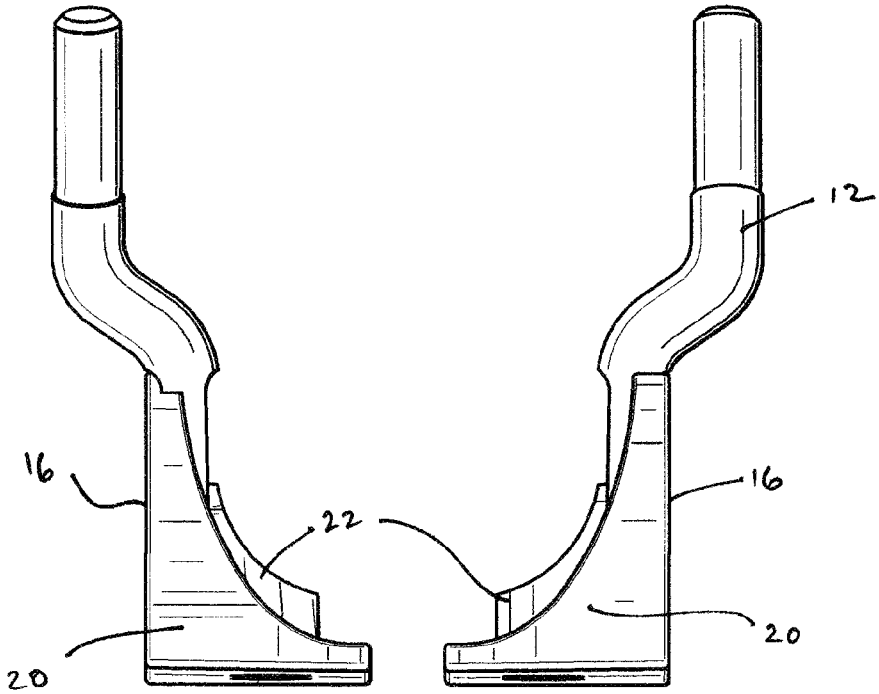
FIGS. 6 and 7 are end views of the putter head.
Figure 8:
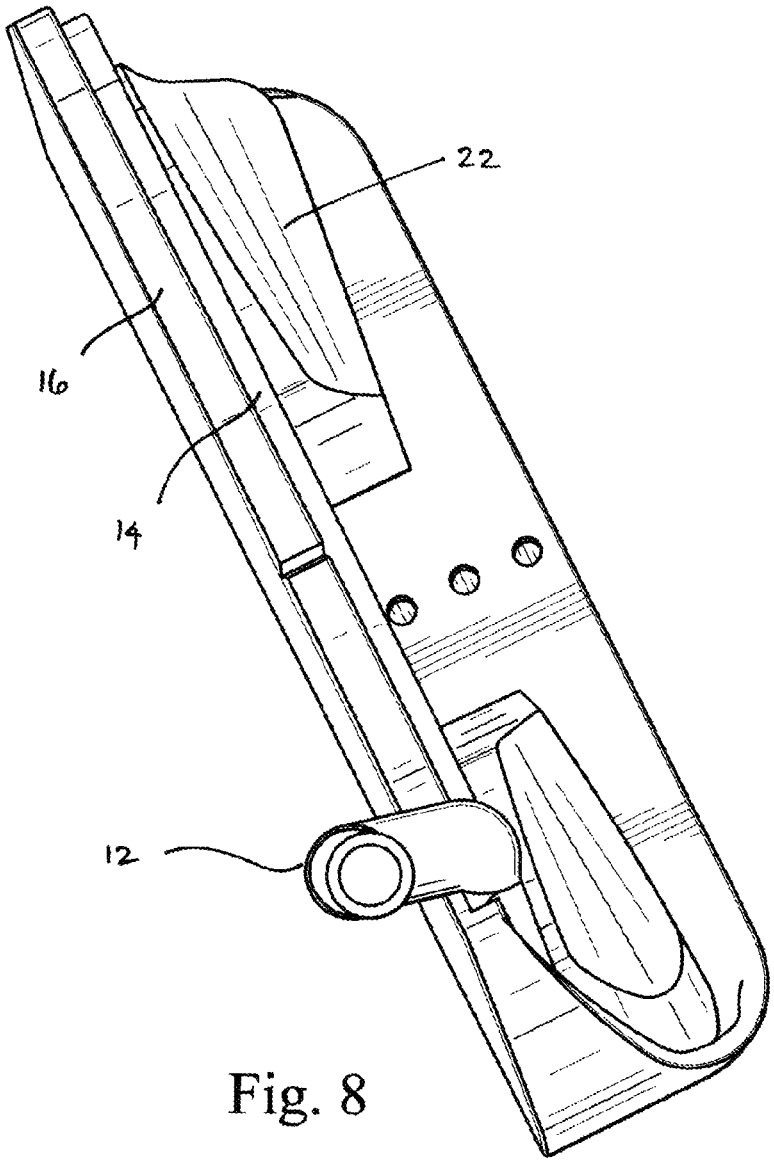
FIG. 8 is a top perspective view of the putter head.

The putter head 10 may additionally include a pair of weights 22. The weights 22 may be removable and/or adjustable via suitable structure. Positioning of the weights 22 in a bottom portion of the frame/putter head serves to increase a moment of inertia (MOI) of the putter. The weights 22 are also shaped in a fashion that helps with alignment of the putter to the line of the putt. For example, as shown in FIG. 4, the shape of the weights 22 defines an alignment channel that is perpendicular to a hitting surface of the putter face 16.

The frame 14 and integral hosel 12 are preferably formed of stainless steel or other suitable material, and the face 16 is preferably formed of a soft carbon steel material or other suitable material. The face 16 can be secured to the frame 14 via fasteners such as screws 24 or via an adhesive or both. The weights 22 are preferably secured by a removable fastener 26 such as screws or the like.

The putter head includes a novel construction where a frame and hosel allow for an equal and stable force to be applied to the putter face. This structure delivers a uniform feel as well as stable, consistent acceleration to the golf ball. The construction of the frame also creates a large sweet spot on the putter face, similarly creating a uniform feel and acceleration to the golf ball, regardless of what portion of the face impacts the golf ball.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A putter head comprising:

a hosel connectable to a club shaft;

a frame cooperable with the hosel, the frame including a closed border portion surrounding an open area;

a putter face connected to the frame, the putter face including a toe portion and a corresponding toe shoulder and a heel portion and a corresponding heel shoulder and a hitting surface, the toe shoulder and the heel shoulder defining an encasement, wherein a front side of the frame is positioned against an opposite side of the hitting surface within the encasement; and a pair of weights positioned in the encasement respectively adjacent the toe shoulder and the heel shoulder, wherein the weights are disposed on a back side of the frame that is opposite from the front side of the frame.

2. A putter head according to claim 1, wherein the frame is integral with the hosel.

3. A putter head according to claim 1, wherein the hosel and the frame are formed of the same material.

4. A putter head according to claim 1, wherein the putter face is connected to the frame border and covers the open section on a hitting side of the frame.

5. A putter head according to claim 1, wherein the putter face is shaped such that the frame is positioned entirely within the encasement.

6. A putter head according to claim 1, wherein the putter face is secured to the frame via at least one of screws and an adhesive.

7. A putter head according to claim 1, wherein the putter face comprises a generally L-shaped construction defined by a hitting surface and the toe and heel shoulders.

8. A putter head according to claim 1, wherein the weights are positioned adjacent a bottom portion of the frame.

9. A putter head according to claim 1, wherein the weights are shaped and positioned to assist with alignment of the putter head.

10. A putter head according to claim 9, wherein the shape of the weights defines an alignment channel that is perpendicular to a hitting surface of the putter face.

11. A putter head according to claim 1, wherein the hosel and the frame are formed of stainless steel, and wherein the putter face is formed of carbon steel that is softer than the stainless steel.

12. A putter head comprising:

a hosel and an integrated frame coupleable with a club shaft, the frame including a closed border portion surrounding an open area;

an L-shaped putter face attached to the frame, the putter face including a top ledge, a hitting surface and shoulder portions that together define the L-shape and an encasement, wherein the frame is disposed in the encasement such that at least a portion of the frame is disposed under the top ledge of the putter face; and a weighted member positioned in the encasement.

13. A putter head according to claim 12, wherein the weighted member comprises a pair of weights respectively positioned adjacent the shoulder portions.

14. A putter head according to claim 13, wherein the shape of the weights defines an alignment channel that is perpendicular to a hitting surface of the putter face.

15. A putter head according to claim 12, wherein the putter face comprises a toe portion and a heel portion, and wherein the toe portion is taller than the heel portion.

* * * * *